US009347438B2

(12) United States Patent
Zurbach et al.

(10) Patent No.: US 9,347,438 B2
(45) Date of Patent: May 24, 2016

(54) HALL-EFFECT THRUSTER

(75) Inventors: Stephan Joseph Zurbach, Vernon (FR); Frederic Marchandise, Vernon (FR); Michael Oberg, Port-Mort (FR)

(73) Assignee: SNECMA, Paris (FR)

( * ) Notice: Subject to any disclaimer, the term of this patent is extended or adjusted under 35 U.S.C. 154(b) by 323 days.

(21) Appl. No.: 14/123,175

(22) PCT Filed: May 23, 2012

(86) PCT No.: PCT/FR2012/051155
§ 371 (c)(1),
(2), (4) Date: Nov. 29, 2013

(87) PCT Pub. No.: WO2012/164203
PCT Pub. Date: Dec. 6, 2012

(65) Prior Publication Data

US 2014/0090357 A1 Apr. 3, 2014

(30) Foreign Application Priority Data

May 30, 2011 (FR) ..... 11 54713

(51) Int. Cl.
*F03H 1/00* (2006.01)

(52) U.S. Cl.
CPC ..... *F03H 1/0018* (2013.01); *F03H 1/0062* (2013.01); *F03H 1/0068* (2013.01); *F03H 1/0075* (2013.01); *F03H 1/0087* (2013.01)

(58) Field of Classification Search
CPC ... F03H 1/0006; F03H 1/0018; F03H 1/0037; F03H 1/0025; F03H 1/0062; F03H 1/0068; F03H 1/0075; F03H 1/0087; F03H 1/00; B64G 1/405
See application file for complete search history.

(56) References Cited

U.S. PATENT DOCUMENTS 5,892,329 A * 4/1999 Arkhipov ..... H05H 1/54 313/362.1
6,300,720 B1 * 10/2001 Birx ..... F03H 1/0087 315/111.21

(Continued)

FOREIGN PATENT DOCUMENTS

FR 2 895 640 6/2007

OTHER PUBLICATIONS

Bugrova, A. I. et al., "SPT Operation in Machine-Gun Mode", 29th International Electric Propulsion Conference, Total 6 Pages, (Nov. 4, 2005) XP055018502.
Darnon, F. et al., "Spontaneous Oscillations in a Hall Thruster", IEEE Transactions on Plasma Science, vol. 27, No. 1, pp. 98-99, (Feb. 1, 1999) XP011045177.

(Continued)

*Primary Examiner* — Gerald L Sung
*Assistant Examiner* — William Breazeal
(74) *Attorney, Agent, or Firm* — Oblon, McClelland, Maier & Neustadt, L.L.P.

(57) ABSTRACT

A Hall effect thruster includes at least one tank of gas under high pressure, a pressure regulator module, a gas flow rate control device, an ionization channel, a cathode placed in a vicinity of an outlet from the ionization channel, an anode associated with the ionization channel, an electrical power supply unit, an electric filter, coils for creating a magnetic field around the ionization channel, and an additional electrical power supply unit for applying a pulsating voltage between the anode and the cathode.

8 Claims, 3 Drawing Sheets

(56) References Cited

U.S. PATENT DOCUMENTS

| | | | | |
|---|---|---|---|---|
| 6,525,480 | B1 * | 2/2003 | Hargus, Jr. | F03H 1/0068 250/423 R |
| 2002/0116915 | A1 * | 8/2002 | Hruby | F03H 1/0062 60/202 |
| 2007/0145901 | A1 * | 6/2007 | Tamida | F03H 1/0018 315/111.61 |
| 2012/0311992 | A1 * | 12/2012 | Ozaki | F03H 1/0012 60/202 |

OTHER PUBLICATIONS

Mazouffre, S. et al., "Spatio-temporal characteristics of ion velocity in a Hall thruster discharge", Plasma Sources Science and Technology, vol. 19, No. 6, pp. 1-9, (Nov. 23, 2010) XP020201679.

Boeuf, J. P. et al., "Low frequency oscillations in a stationary plasma thruster", Journal of Applied Physics, vol. 84, No. 7, pp. 3541-3554, (Oct. 1, 1998) XP012045922.

International Search Report Issued Sep. 21, 2012 in PCT/FR12/051155 Filed May 23, 2012.

* cited by examiner

HALL-EFFECT THRUSTER

FIELD OF THE INVENTION

The present invention relates to a Hall effect thruster, also known as a stationary plasma thruster.

PRIOR ART

A Hall effect thruster essentially comprises an ionization and discharge channel that is associated with an anode, and a cathode arranged in the vicinity of the outlet from the ionization and discharge channel. The ionization and discharge channel is made of an insulating material such as a ceramic. A magnetic circuit and electromagnetic coils surround the ionization and discharge channel. An inert gas such as xenon is injected into the rear of the discharge channel and into the cathode. The inner gas is ionized in the ionization and discharge channel by colliding with electrons emitted by the cathode. The ions that are produced are accelerated and ejected by the axial electric field created between the anode and the cathode. Within the channel, the magnetic circuit and the electromagnetic coils create a magnetic field that is essentially radial.

FIG. 2 is a diagrammatic axial section view of an example of a closed electron drift type Hall effect thruster.

In FIG. 2, there can be seen an annular channel 21 defined by a part 22 made of insulating material, such as a dielectric ceramic, a magnetic circuit 24 having external and internal annular pole pieces 24*a* and 24*b*, a magnetic yoke 24*d* arranged at the upstream end of the thruster, and a central core 24*c* connecting together the annular pole pieces 24*a*, 24*b* and the magnetic yoke 24*d*. Coils 31, 32 serve to create a magnetic field in the annular channel 21. A hollow cathode 40 is coupled to a xenon feed device for forming a cloud of plasma in front of the downstream outlet of the channel 21. An anode 25 is arranged in the annular channel 21 and is associated with an annular manifold 27 for ionizable gas (xenon). A housing 20 protects the thruster as a whole.

In FIG. 2, magnetic field lines B, the electric field E, atoms a, ions i, and electrons e created from the injected ionizable gas are all represented symbolically.

In a Hall effect thruster of the kind shown in FIG. 2, atoms of propellant such as xenon are ionized with a discharge that is confined in the channel 21. The resulting ions i are accelerated in an electric field E created by the anode 25 and ejected via the open downstream outlet 26 of the annular channel 21 so as to generate the thrust effect.

An azimuth electron current of several tens of amps is created inside the channel 21 as a result of the mainly axial electric field E in combination with the mainly radial magnetic field B.

Examples of Hall effect thrusters are described in particular in the following documents: FR 2 693 770 A1, FR 2 743 191 A1, FR 2 782 884 A1, and FR 2 788 084 A1.

Hall effect thrusters present two major limitations in terms of operation.

A first limitation consists in the limited lifetime resulting from the ceramic of the discharge channel being eroded. Some of the ions created by the engine are accelerated in the discharge channel towards the walls of the engine. Given their energy, these ions erode the ceramic of the discharge channel, thereby limiting the lifetime of the thruster.

A second limitation lies in the drop in the efficiency of the engine and the acceleration in the aging of the engine at high levels of specific impulse (Isp). The specific impulse of a stationary plasma thruster is increased essentially by increasing the discharge voltage Ud. This leads to generating a plasma that is hotter and that interacts strongly with the walls of the discharge channel. Under such circumstances, the energy of the electrons increases significantly until reaching levels that are incompatible with the ceramic of the channel in the engine. The greater speed of the ions also contributes to increasing the rate at which the ceramic of the engine is eroded.

That is why, until now, it has been necessary to use Hall effect thrusters that present limited specific impulse, which specific impulse may typically be of the order of 1000 seconds (s) to 2500 s.

In order to increase the lifetime of a Hall effect engine, proposals have already been made to make discharge channels that are movable in translation. When the chamber becomes eroded, the ceramic of the discharge channel is caused to advance along the axis of the engine. Nevertheless, this does not make it possible to overcome the problem of the limitation on operation at high voltage.

Bombardment ion thrusters are also known that have grids for accelerating ions and that can operate with levels of specific impulse greater than 4000 s. Nevertheless, the use of grids present certain drawbacks.

OBJECT AND BRIEF DESCRIPTION OF THE INVENTION

An object of the present invention is to remedy the drawbacks of prior art plasma thrusters, and more particularly to modify Hall effect thrusters or closed electron drift plasma thrusters, in order to improve their technical characteristics, and in particular to improve specific impulse and lengthen lifetime with a significant reduction in the erosion of the discharge channel.

These objects are achieved by a Hall effect thruster comprising at least one tank of gas under high pressure, a pressure regulator module, a gas flow rate control device, an ionization channel, at least one cathode placed in the vicinity of the outlet from the ionization channel, an anode associated with the ionization channel, an electrical power supply unit, an electric filter, and coils for creating a magnetic field around the ionization channel, the thruster being characterized in that it further comprises an additional electrical power supply unit for applying a pulsating voltage between said anode and said at least one cathode and in that the additional electrical power supply unit produces in alternation a first discharge voltage ($Ud_{min}$) for a first duration ($t_{tot}-t_{j/A}$) lying in the range 5 microseconds (μs) to 15 μs, and a second discharge voltage ($Ud_{max}$) for a second duration ($t_{j/A}$) lying in the range 5 μs to 15 μs.

Advantageously, the additional electrical power supply unit produces in alternation a first discharge voltage ($Ud_{min}$) lying in the range 150 volts (V) to 250 V and a second discharge voltage ($Ud_{max}$) lying in the range 300 V to 1200 V.

Preferably, said first duration ($t_{tot}-t_{j/A}$) lies in the range 5 μs to 10 μs, and said second duration ($t_{j/A}$) lies in the range 5 μs to 10 μs.

According to a preferred characteristic, the first discharge voltage ($Ud_{min}$) lies in the range 180 V to 220 V, and the second discharge voltage ($Ud_{max}$) lies in the range 400 V to 1000 V.

The additional electrical power supply unit includes at least one capacitor.

In a particular embodiment, the additional electrical power supply unit produces in alternation a first discharge voltage ($Ud_{min}$) and a second discharge voltage ($Ud_{max}$) respectively for a first duration ($t_{tot}-t_{j/A}$) and for a second duration ($t_{j/A}$), which durations are substantially equal.

According to a particular aspect of the invention, the coils for creating a magnetic field are powered by said electrical power supply unit and said electric filter independently of the anode being powered by the additional electrical power supply unit and said electric filter.

BRIEF DESCRIPTION OF THE DRAWINGS

Other characteristics and advantages of the invention appear from the following description of particular embodiments, given as non-limiting examples and with reference to the accompanying drawings, in which.

DETAILED DESCRIPTION OF PARTICULAR EMBODIMENTS

Figure 2:
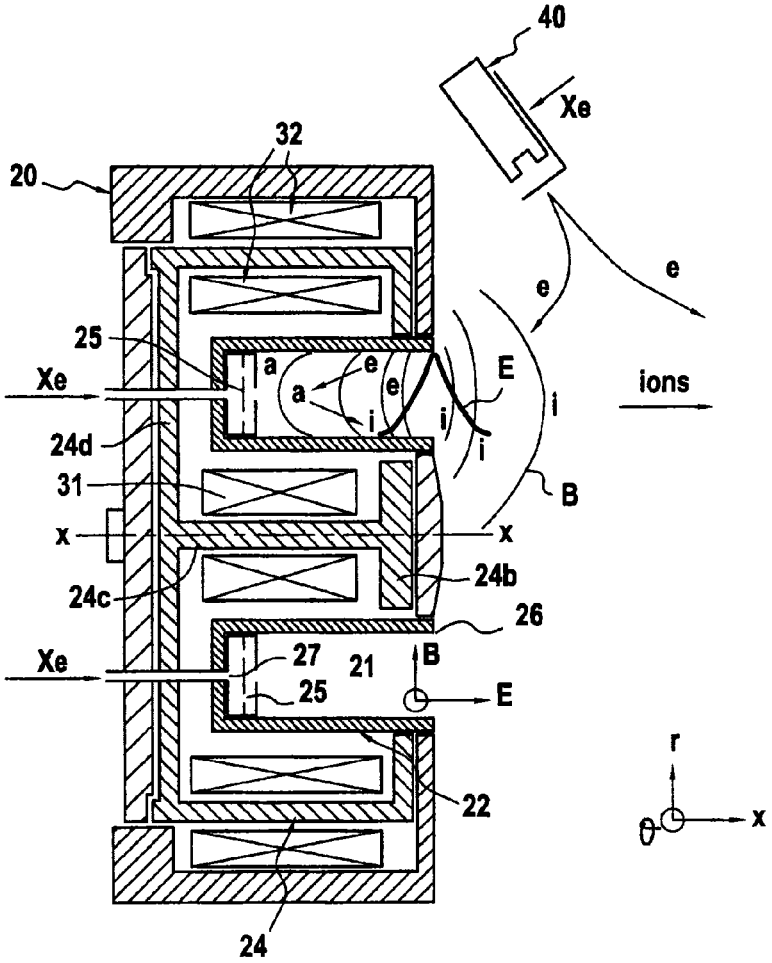
FIG. 2 is a diagrammatic axial section view showing an example of a Hall effect thruster to which the invention is applicable.

The invention relates to a Hall effect thruster of general structure as described above with reference to FIG. 2.

Although often referred to as a "stationary plasma thruster", the operation of a conventional Hall effect thruster is far from being steady. Several frequency ranges may be considered lying in the range 20 kilohertz (kHz) to several gigahertz.

At low frequency, a conventional Hall effect thruster is essentially characterized by the following phases:

a) filling the discharge channel with inert atoms of a propellant such as xenon;

b) ionizing the inert atoms with energetic electrons in the downstream half of the thruster; and c) accelerating and ejecting the ions that have been created by means of the electric field E, which is proportional to the discharge voltage Ud of the thruster.

The same three-phase cycle is restarted periodically.

Figure 3:
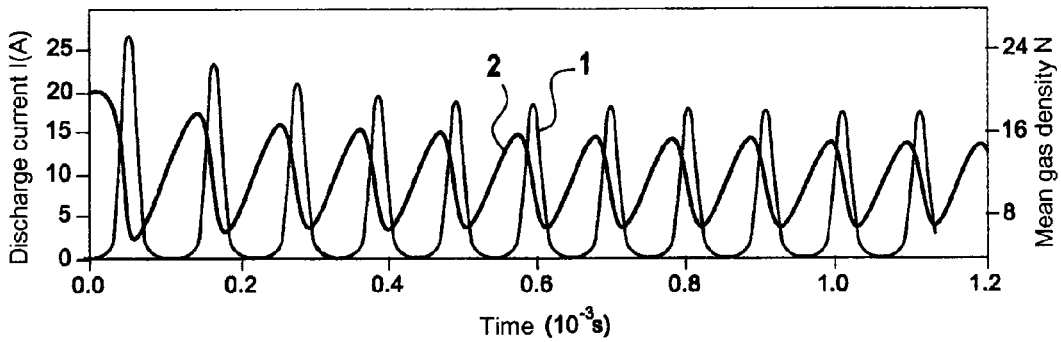
FIG. 3 is a graph showing curves representing the variation in the discharge current I and in the mean density of the gas N as a function of time in the form of low frequency oscillations for a Hall effect thruster to which the invention can be applied.

FIG. 3 shows a simplified model of the oscillations in a Hall effect thruster.

FIG. 3 shows the discharge current I as a function of time (curve 1) and the mean gas density N as a function of time (curve 2).

The oscillations of the ionization/acceleration front can clearly be seen as a result of the oscillation in space of the inert gas density.

A Hall effect thruster is thus characterized by alternations of an ionization/acceleration front ejecting ionized inert gas and a front of non-ionized inert gas filling the discharge chamber of the thruster.

In a conventional Hall effect thruster, the discharge voltage Ud of the thruster is set at a predetermined level that is high enough to enable hot electrons to be produced suitable for achieving good ionization and acceleration of the ions in a high electric field.

The discharge voltage Ud of conventional Hall effect thrusters is kept essentially constant during operation. As mentioned above, the value of this discharge voltage Ud is selected to have a level that makes it possible to limit the rate at which the ceramic of the discharge channel is eroded, typically a value of about 300 V to 350 V, but this also leads to limiting the resulting specific impulse.

The Hall effect thruster of the invention makes it possible to obtain high specific impulse but without that increasing the rate at which the ceramic of the discharge channel is eroded, and without requiring any modification to the mechanical structure of the thruster.

To achieve this, while the Hall effect thruster of the invention is in operation, the discharge voltage Ud of the thruster is caused to pulsate so as to control the propagation of the ionization/acceleration front of the thruster by reducing the amplitude of the spatial oscillations of the inert atom consumption within the thruster.

This avoids forming and then accelerating ions too far upstream in the channel of the thruster, thereby significantly limiting erosion of the channel, by periodically reducing the discharge voltage.

Figure 4:
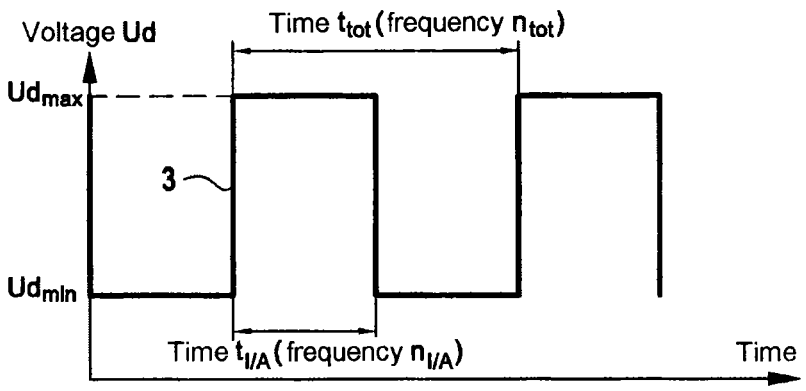
FIG. 4 is a graph in which a curve shows an example of how the discharge voltage Ud varies as a function of time, which voltage Ud alternates in accordance with the invention between a high voltage $Ud_{max}$ and a low voltage $Ud_{min}$.

FIG. 4 shows the operation of the thruster with a discharge voltage Ud oscillating over time between a low discharge voltage equal to $Ud_{min}$ and a high discharge voltage equal to $Ud_{max}$ (curve 3).

Initially, the discharge voltage Ud is set to the low value equal to $Ud_{min}$. When the channel of the thruster has filled with inert atoms, the discharge voltage Ud is set to the high value equal to $Ud_{max}$ for a time which may for example lie in the range 5 μs to 15 μs, and more preferably in the range 5 μs to 10 μs, with a value close to 10 μs giving good results.

The total time $t_{tot}$ of a cycle with a high voltage value $Ud_{max}$ and a low voltage value $Ud_{min}$ is determined by the rate at which the channel of the thruster fills with inert atoms, and may for example lie in the range 10 μs to 30 μs, and preferably in the range 10 μs to 20 μs, with a value close to 20 μs giving good results.

The voltage $Ud_{min}$ may for example lie in the range 150 V to 250 V, and more preferably in the range 180 V to 220 V.

The voltage $Ud_{max}$ may for example lie in the range 300 V to 1200 V, and more preferably in the range 400 V to 1000 V.

FIG. 4 shows an example of pulsating operation in which the durations $t_{j/A}$ and $t_{tot}-t_{j/A}$ for which the discharge voltage is equal respectively to $Ud_{max}$ and $Ud_{min}$ are substantially equal, but that is not essential.

The frequency at which the value Ud oscillates between the minimum value $Ud_{min}$ and the maximum value $Ud_{max}$ depends on the level determined for the voltage $Ud_{max}$, which then determines the value of the specific impulse of the thruster.

Figure 1:
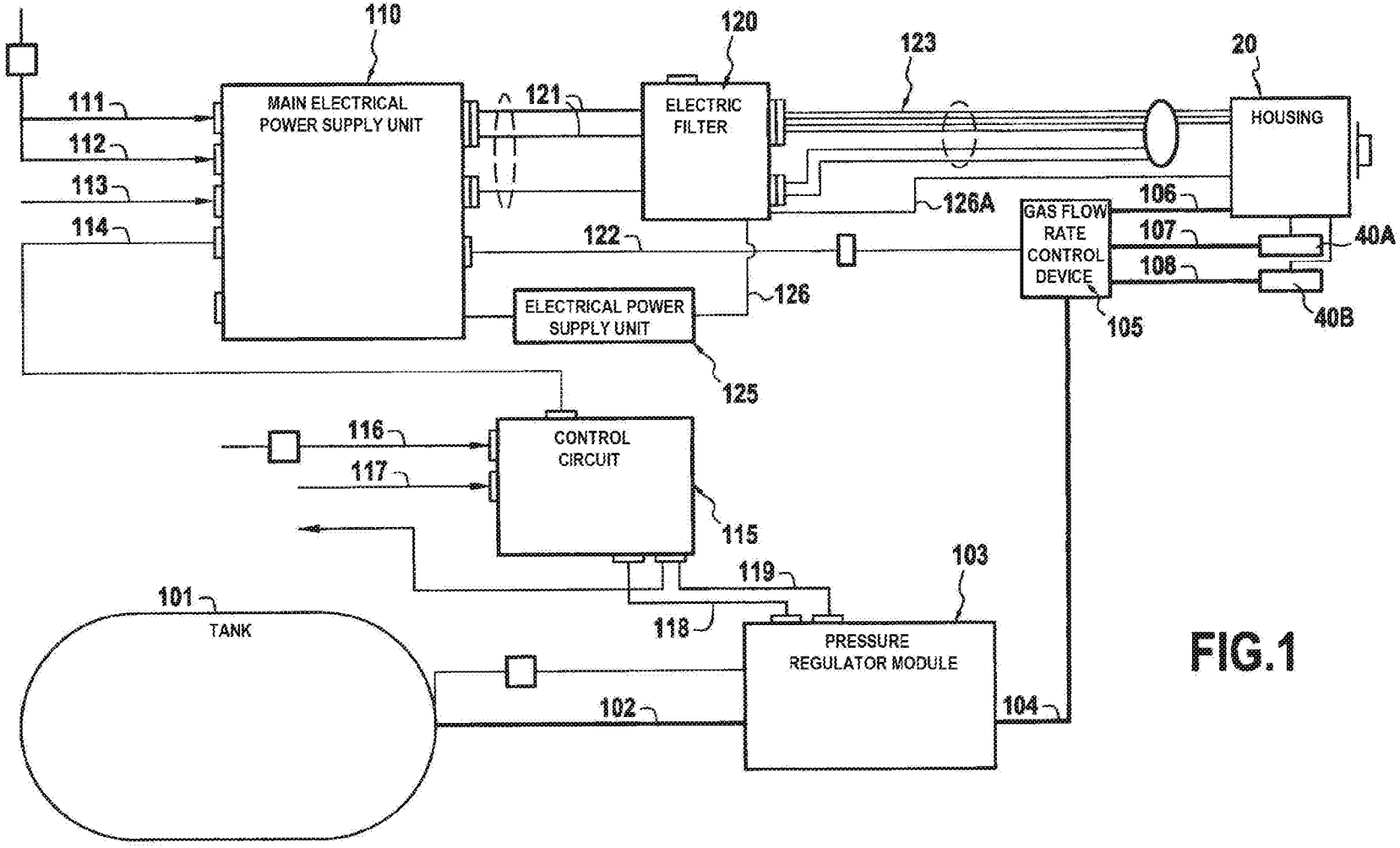
FIG. 1 is a block diagram of a Hall effect thruster of the invention in association with its electrical power supply.

FIG. 1 is a block diagram showing the general structure of a Hall effect thruster of the invention together with its supplies of gas and electricity.

A tank 101 of ionizable gas such as xenon is connected by a pipe 102 to a pressure regulator module 103, itself connected by a pipe 104 to a gas flow rate control device 105 for feeding a gas manifold within the housing 20 containing the discharge channel and also the cathodes 40A and 40B via respective hoses 106, 107, and 108. Using two cathodes 40A and 40B instead of a single cathode is not essential, and merely constitutes redundancy for reasons of safety.

A main electrical power supply unit 110 is connected via connections 121 to an electric filter 120 that serves in turn to power coils via connections 123 for creating a magnetic field around the ionization and discharge channel, which coils are arranged inside the housing 20. A direct connection 122 between the main unit 110 and the gas flow rate control device 105 serves to control the control device.

The main electrical power supply unit 110 receives electrical energy produced by an external source, such as solar panels, via lines 111, 112, and 113, and it converts this electrical energy, which may typically be delivered at a voltage of 50 V for example, into electrical energy at a higher voltage, of the order of several hundreds of volts.

In particular, the main electrical power supply unit 110 has circuits for generating an analog control signal that is applied via a line 122 to the gas flow rate control device 105.

The main electrical power supply unit 110 receives data via a line 114 from a control circuit 115 that is associated with the module 103 for regulating the pressure of the gas delivered from the gas tank 101 to the gas flow rate control device 105.

The control circuit 115 receives information from sensors and concerning the states of valves in the gas pressure regulator module 103 via lines 118 and 119, and it receives external data via lines 116, 117. The data transmitted over the line 114 from the control circuit 115 to the main electrical power supply unit 110 serves to generate the analog control signal that is applied by the line 122 to the gas flow rate control device 105.

The additional electrical power supply unit 125 that is connected to the electrical power supply unit 110 acts via lines 126, 126A, and the filter 120 to feed electricity to the anode incorporated in the housing 20.

The additional electrical power supply unit 125 that co-operates with the cathodes 40A, 40B and with the anode 25 for creating an electric field acts together with the filter 120 to feed a pulsating voltage between the anode 25 and each of the cathodes 40A, 40B, while in parallel the electromagnetic coils included in the housing 20 are powered by the electrical power supply unit 110 and the filter 120.

The additional electrical power supply unit 125 serves to produce two distinct voltage levels, namely a low level voltage, e.g. of about 200 V and also a high level voltage of the order of several hundreds of volts, possibly up to about 1200 volts.

By way of indication, the current may be 2 amps (A) at a low voltage of 200 V and 7 A at a high voltage of 400 V.

The energy stored in the additional electrical power supply unit 125 must be released at very accurate moments. By way of example, the frequency used for the discharges is close to 100 kHz, with a complete cycle occupying a period of 20 μs.

The additional electrical power supply unit 125 may include capacitors with a capacitance of several microfarads or several tens of microfarads, e.g. in order to be able to charge and discharge over a cycle of 20 μs (50 kHz) with an electric charge corresponding to 7 A during 10 μs, i.e. an electric charge of 70 micro amp seconds (μAs).

The charging and discharging the capacitors of the additional electrical power supply unit 125 may be controlled and managed by control circuits that are associated with the additional electrical power supply unit 125 or that are incorporated in the electrical power supply unit 110, in such a manner as to enable the additional electrical power supply unit 125 to output two different power levels in alternation.

The first power level corresponds to low power, thereby enabling the discharge channel to be filled with inert atoms, while the second power level corresponds to a high power, e.g. delivering a current in the range 7 A to 10 A at a voltage in the range 400 V to 1 kilovolt (kV) for a duration of 5 μs to 10 μs, which corresponds for each high-power pulse to energy that may typically lie in the range 14 millijoules (mJ) (7 A, 400 V, and 5 μs) to 100 mJ (10 A, 1 kV, and 10 μs) for the range of values that is considered as being preferred, but not limiting.

The high power level corresponds to the ionization/acceleration process in the discharge channel of the engine. The fact that the high power level is pulsed makes it possible to select relatively high values leading to high levels of specific impulse without shortening the lifetime of the engine.

In general, the main electrical power supply unit 110 and the additional electrical power supply unit 125 are constituted by electrical circuits serving firstly to deliver low power to the gas flow rate control device 105 and secondly to deliver high power both to the electromagnetic coils included in the housing 20 and also to the cathodes 40A and 40B co-operating with the anode 25. The main electrical power supply unit 110 and the additional electrical power supply unit 125 define at least two distinct power supply modules that are connected in series and/or in parallel so as to make it possible to switch between the two power levels that are required for the looked-for operation of the thruster.

The filter 120 may be constituted by filter elements included in the power supply modules constituting the units 110 and 125 in order to protect them from the effects of electromagnetic compatibility (EMC) stemming from the thruster.

The invention claimed is:

1. A Hall effect thruster comprising: at least one tank of gas under high pressure; a pressure regulator module; a gas flow rate control device; an ionization channel; at least one cathode placed in a vicinity of an outlet from the ionization channel; an anode associated with the ionization channel; an electrical power supply unit; an electric filter; coils for creating a magnetic field around the ionization channel; an additional electrical power supply unit for applying a pulsating voltage between the anode and the at least one cathode, and wherein the additional electrical power supply unit produces in alternation a first discharge voltage for a first duration of 5 μs to 15 μs, and a second discharge voltage for a second duration of 5 μs to 15 μs.

2. A thruster according to claim 1, wherein the additional electrical power supply unit produces in alternation the first discharge voltage of 150 V to 250 V and the second discharge voltage of 300 V to 1200 V.

3. A thruster according to claim 1, wherein the first duration is from 5 μs to 10 μs, and the second duration is from of 5 μs to 10 μs.

4. A thruster according to claim 1, wherein the first discharge voltage is from 180 V to 220 V, and the second discharge voltage is from 400 V to 1000 V.

5. A thruster according to claim 1, wherein the additional electrical power supply unit includes at least one capacitor.

6. A thruster according to claim 1, wherein the additional electrical power supply unit produces in alternation the first discharge voltage and the second discharge voltage respectively for the first duration and for the second duration, which durations are equal.

7. A thruster according to claim 1, wherein the coils for creating the magnetic field are powered by the electrical power supply unit and the electric filter independently of the anode being powered by the additional electrical power supply unit and the electric filter.

8. A thruster according to claim 1, wherein the ionization channel is defined by a wall made of ceramic material.

* * * * *